US010897939B1

(12) United States Patent
Hopkins et al.

(10) Patent No.: US 10,897,939 B1
(45) Date of Patent: Jan. 26, 2021

(54) STRAP ASSEMBLY FOR CONNECTING PROTECTIVE SLEEVES FOR WORK WITH HIGH-VOLTAGE ELECTRICITY

(71) Applicant: DC Invents, LLC, Hardwick, VT (US)

(72) Inventors: Cody Hopkins, Hardwick, VT (US); Dylan Morrill, Johnson, VT (US)

(73) Assignee: DC Invents, LLC, Hardwick, VT (US)

( * ) Notice: Subject to any disclaimer, the term of this patent is extended or adjusted under 35 U.S.C. 154(b) by 0 days.

(21) Appl. No.: 16/744,259

(22) Filed: Jan. 16, 2020

(51) Int. Cl.
*A41D 13/05* (2006.01)
*A44B 11/02* (2006.01)

(52) U.S. Cl.
CPC ..... *A41D 13/0568* (2013.01); *A44B 11/02* (2013.01)

(58) Field of Classification Search
CPC .... A41D 13/0568; A41D 13/08; A44B 11/02; A44B 11/04; A44B 11/06; A44B 11/12; A44B 11/065; A44B 11/125; B65D 63/16
USPC ..... 2/338, 340
See application file for complete search history.

(56) References Cited

U.S. PATENT DOCUMENTS 725,437 A * 4/1903 Gluckauf ..... A41F 9/002 2/301
1,136,610 A * 4/1915 Pilkington ..... A44B 11/06 24/168
1,493,888 A * 5/1924 Miller ..... A44B 11/12 24/191
1,538,894 A * 5/1925 Hatheway ..... A44B 11/12 24/191
1,782,057 A * 11/1930 Bollinger ..... A41F 19/005 24/301
1,908,038 A * 5/1933 MacKenzie ..... A41F 9/002 2/321
2,191,228 A * 2/1940 Dowd ..... A44B 11/125 24/170
2,388,234 A 11/1945 Abel
2,511,579 A * 6/1950 George ..... A44B 11/10 24/171
2,751,656 A * 6/1956 Noe ..... A44B 11/14 24/170
2,895,480 A * 7/1959 Fixel ..... A41F 17/00 450/29
2,911,653 A * 11/1959 O'Donnell ..... A41F 9/002 2/321
3,920,166 A * 11/1975 Hogensen, Jr. ..... A45F 5/00 224/586

(Continued)

FOREIGN PATENT DOCUMENTS

EP 3378345 A1 * 9/2018 ..... A44B 11/125
WO 2018055362 3/2018

*Primary Examiner* — Alissa L Hoey
(74) *Attorney, Agent, or Firm* — Caldwell Intellectual Property

(57) ABSTRACT

A strap assembly includes first second connectors that attach to protective sleeves, a strap with one end at the first connector and passing through a slot at the second connector, a strap adjustment clip with a base member connected to the second end of the strap and an upper surface, a locking member rotatably attached to the base member with the strap in between. The locking member is rotatable between a locked position and an open position and has a lever extension having and a strap lock extension including a strap lock distal end that traps the strap body against the upper surface of the base member when the locking member is in the locked position.

17 Claims, 9 Drawing Sheets

(56) References Cited

U.S. PATENT DOCUMENTS 4,631,784 A * 12/1986 Fildan ..... A44B 11/12 24/170
4,726,625 A * 2/1988 Bougher ..... A44B 11/12 24/170
4,843,688 A * 7/1989 Ikeda ..... A44B 11/12 24/170
4,881,303 A * 11/1989 Martini ..... A44B 11/14 24/170
4,942,647 A * 7/1990 Wallner ..... A44B 11/125 24/170
5,005,527 A * 4/1991 Hatfield ..... A01K 27/005 119/793
5,144,695 A * 9/1992 Schweizer ..... A42B 3/08 2/175.6
5,269,050 A * 12/1993 Yewer, Jr. ..... A44B 11/12 128/876
5,313,669 A * 5/1994 Rasdell ..... A41F 17/00 2/107
5,611,118 A * 3/1997 Bibbee ..... A42B 7/00 2/195.1
5,661,877 A * 9/1997 Bloomer ..... A44B 11/12 24/170
5,666,909 A * 9/1997 Dupre ..... A01K 27/003 119/797
5,732,660 A * 3/1998 David ..... A01K 25/00 119/792
6,179,687 B1 * 1/2001 Lee ..... A41F 1/006 2/67
6,381,810 B2 * 5/2002 Hsieh ..... A44B 11/06 24/170
6,389,605 B2 * 5/2002 Srivastava ..... A41F 1/00 2/311
6,665,913 B2 * 12/2003 Kosh ..... A44B 11/12 24/170
8,087,609 B2 1/2012 Moore
8,365,685 B2 * 2/2013 Simons ..... A01K 1/0613 119/756
8,393,016 B2 * 3/2013 Wilkins-Gaudio ..... A41F 9/002 2/312
8,935,833 B2 * 1/2015 Kaneko ..... A44B 11/065 24/170
10,363,452 B2 7/2019 Alaniz, III
10,485,274 B2 11/2019 Allen
2004/0143941 A1 * 7/2004 Lee ..... A44B 11/12 24/191
2006/0174456 A1 * 8/2006 Small ..... A44B 11/12 24/307
2008/0209702 A1 * 9/2008 Van Dine ..... A43C 11/14 24/68 SK
2009/0186555 A1 * 7/2009 Fildan ..... A41F 1/006 450/77
2010/0325842 A1 * 12/2010 Rivera ..... G09F 3/16 24/3.4
2012/0324615 A1 12/2012 Heimann
2013/0036537 A1 * 2/2013 Reynolds ..... F41H 1/02 2/456
2014/0283301 A1 * 9/2014 Whaley ..... A47C 21/022 5/496
2015/0018732 A1 1/2015 Thornton
2016/0157538 A1 * 6/2016 Bortolotto ..... A45C 13/30 2/300
2017/0188641 A1 * 7/2017 Bell ..... A41F 9/025
2017/0215559 A1 8/2017 Ciptak et al.
2017/0280790 A1 10/2017 Verma et al.
2018/0184734 A1 * 7/2018 Hughes ..... A41D 13/08
2019/0142085 A1 5/2019 Wilson et al.

* cited by examiner

STRAP ASSEMBLY FOR CONNECTING PROTECTIVE SLEEVES FOR WORK WITH HIGH-VOLTAGE ELECTRICITY

FIELD OF THE INVENTION

The present invention generally relates to the field of equipment for electrical work. In particular, the present invention is directed to strap assembly for connecting protective sleeves for work with high-voltage electricity.

BACKGROUND

Protective clothing is essential when working in high-voltage environments such as those found when maintaining power lines. Protective sleeves can help reduce risks of heat and electrocution from arcs, sparking, hot wires, and other hazards by resisting electrical conduction and providing an additional barrier to heat and hot material. However, existing methods for securing such sleeves to the person of an individual provide inadequate safety features and ease of use.

SUMMARY OF THE DISCLOSURE

In an aspect a strap assembly for connecting protective sleeves for work with high-voltage electricity includes a first connector and a second connector, where the first connector is configured to connect to a first protective sleeve and the second connector is configured to connect to a second protective sleeve. The strap assembly includes a strap having a first end affixed to the first connector, a second end, and a strap body connecting the first end to the second end, where the strap body passes through a slot in the second connector. The strap assembly includes a strap adjustment clip. The strap adjustment clip includes a base member affixed to the second end of the strap, the base member including a front end, a rear end, and an upper surface disposed on a first side of the strap body. The strap adjustment clip includes a locking member rotatably attached to the base member and disposed on a second side of the strap body. The locking member is rotatable between a locked position and an open position. The locking member includes a fulcrum attached to the base member, a lever extension having a lever extension distal end, and a strap lock extension. The strap lock extension includes a strap lock proximal end at the fulcrum and a strap lock distal end that traps the strap body against the upper surface of the base member when the locking member is in the locked position, preventing the strap body from sliding between the base member and the locking member. The lever extension is manually engageable to rotate the locking member between the locked position and the open position.

These and other aspects and features of non-limiting embodiments of the present invention will become apparent to those skilled in the art upon review of the following description of specific non-limiting embodiments of the invention in conjunction with the accompanying drawings.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

The drawings are not necessarily to scale and may be illustrated by phantom lines, diagrammatic representations and fragmentary views. In certain instances, details that are not necessary for an understanding of the embodiments or that render other details difficult to perceive may have been omitted.

DETAILED DESCRIPTION

In embodiments disclosed herein, a strap assembly featuring an attachment clip is presented. Strap assembly may be formed of a combination of materials furnishing protection against hazardous conditions such as high-voltage environments, such as electrical insulation, heat resistance, melt-proofing, and other attributes desirable where arcs or contact with high voltage conductors are possible. Clip may be highly secure and may be formed to readily release even after exposure to unusual temperatures or other conditions.

Figure 1:
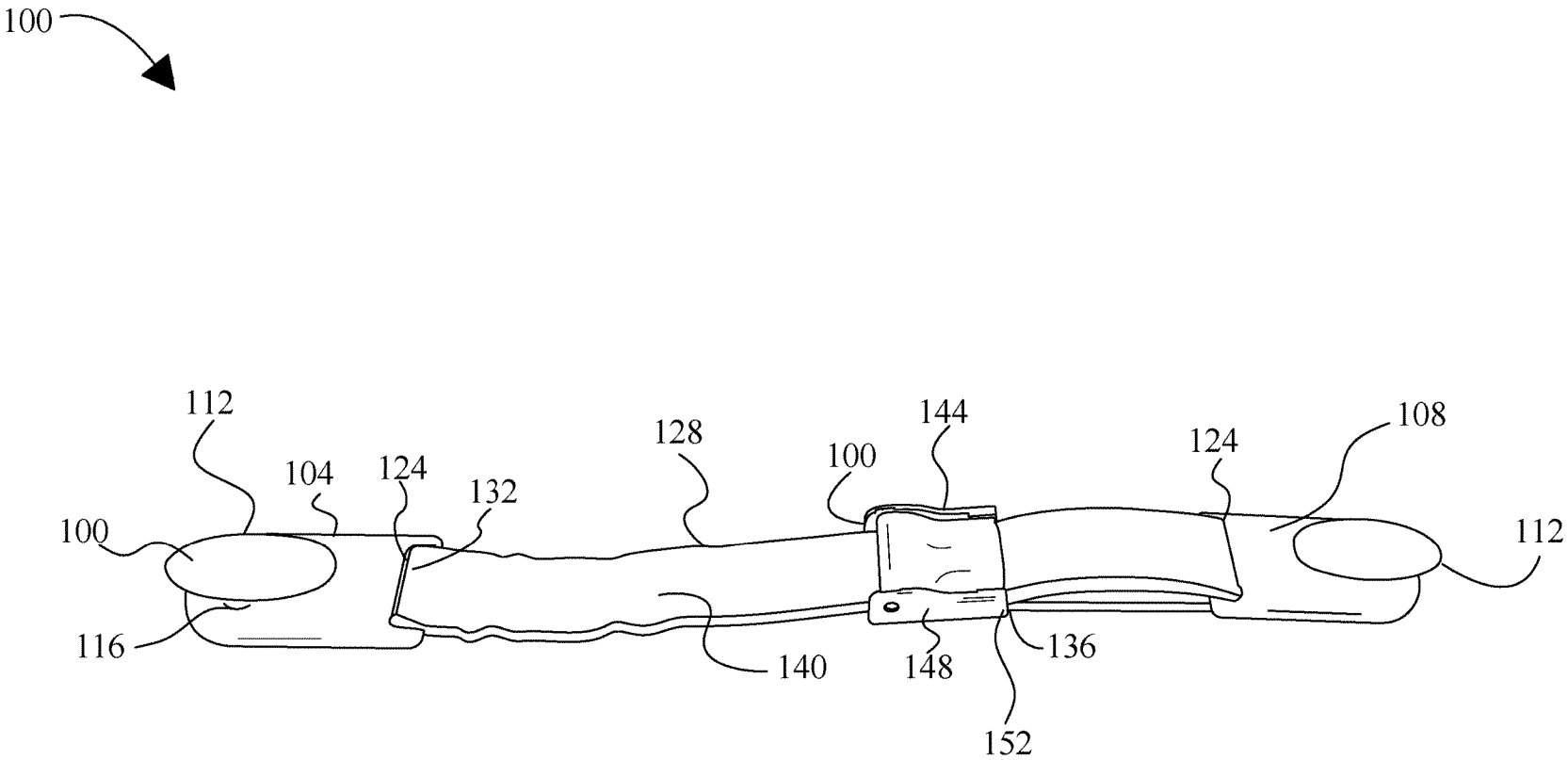
FIG. 1 is a schematic diagram illustrating an exemplary embodiment of a strap assembly.

Referring now to FIG. 1, an exemplary embodiment of a strap assembly 100 for connecting protective sleeves for work with high-voltage electricity is illustrated. Strap assembly 100 includes a first connector 104 and a second connector 108. First connector 104 and second connector 108 may be constructed of any suitable material or combination of materials. Materials making up first connector 104 and/or second connector 108 may include, without limitation, natural or artificial polymers with or without additives to provide desired physical properties as described below. Polymer materials may include, without limitation, high-density polymer materials; for instance, polymer materials may include without limitation acrylonitrile butadiene styrene (ABS), high-density polyethylene (HDPE), polyethylene high-density (PEHD), Polyvinyl chloride (PVC), Polycarbonate plus Acrylonitrile Butadiene Styrene (PC+ABS), and/or polycarbonate (PC). Polymer materials may include Melamine formaldehyde (MF). Polymer materials may include Polyetheretherketone (PEEK). Materials making up first connector 104 and/or second connector 108 may alternatively or additionally include plant materials such as wood or bamboo, metals, composite materials such as fiberglass, ceramics, glass, or any combination thereof.

Still referring to FIG. 1, first connector 104 and/or second connector 108 may have an effectively rigid body, where "effective rigidity" indicates an apparent degree of rigidity consistent with use for buckles, snaps, and/or other rigid-bodied fasteners used in articles of clothing. An effectively rigid material and/or article may exhibit flexibility, rigidity, and/or properties relevant thereto that are apparently similar to ABS. For instance, and without limitation, an effectively rigid body may have a rigidity, pliability, and/or elasticity that appears similar to ABS at room temperature. An effectively rigid body may have a substantially similar flexural modulus, bending modulus, elastic modulus, tensile modulus, and/or Young's modulus to ABS. An effectively rigid body may have an apparently similar stiffness to ABS. An effectively rigid body may have a flexural modulus greater than 1 GPa. An effectively rigid body may have a tensile modulus greater than 1 GPa. Persons skilled in the art, upon reviewing the entirety of this disclosure, will be aware of various materials that may be viewed as effectively rigid as consistent with usages in this disclosure.

With continued reference to FIG. 1, material and/or combination of materials making up first connector 104 and/or second connector 108 may exhibit one or more additional properties. For instance, and without limitation, materials may be fire-retardant, where "fire retardant" is defined for the purposes of this disclosure as tending to slow or stop the spread of fire; materials may alternatively or additionally be described as flame-retardant. A material may be flame-retardant and/or fire-retardant where the material is deemed to be flame-retardant and/or fire retardant under NFPA 2112-2012 or an equivalent standard. As a further non-limiting example, materials may be melt-proof, where a "melt-proof" material is defined for the purposes of this disclosure as a material that does not melt to any extent detectable by a human observer when subjected to heat within a range encountered in a work environment within which that material may be deployed. A material may be melt-proof where the material is deemed to be melt-proof under NFPA 2112-2012 or an equivalent standard. Materials may have high electrical resistivity; resistivity may, as a non-limiting example, be greater than $1\times10^{10}$ Ohms per cm. Materials may have a high tensile strength. High tensile strength may be a strength equal to or exceeding that of ABS, and/or tensile strength between 30 and 42 MPa. A non-limiting example of a material usable for first connector 104 and/or second connector may be flame-retardant ABS, which may be ABS with a flame-retardant additive.

Still referring to FIG. 1, first connector 104 and/or second connector 108 may be constructed using any suitable manufacturing process, including without limitation additive manufacturing such as "3D printing" or stereolithography, subtractive manufacturing such as machining, molding such as injection molding, assembly, or any combination thereof.

Figure 2:
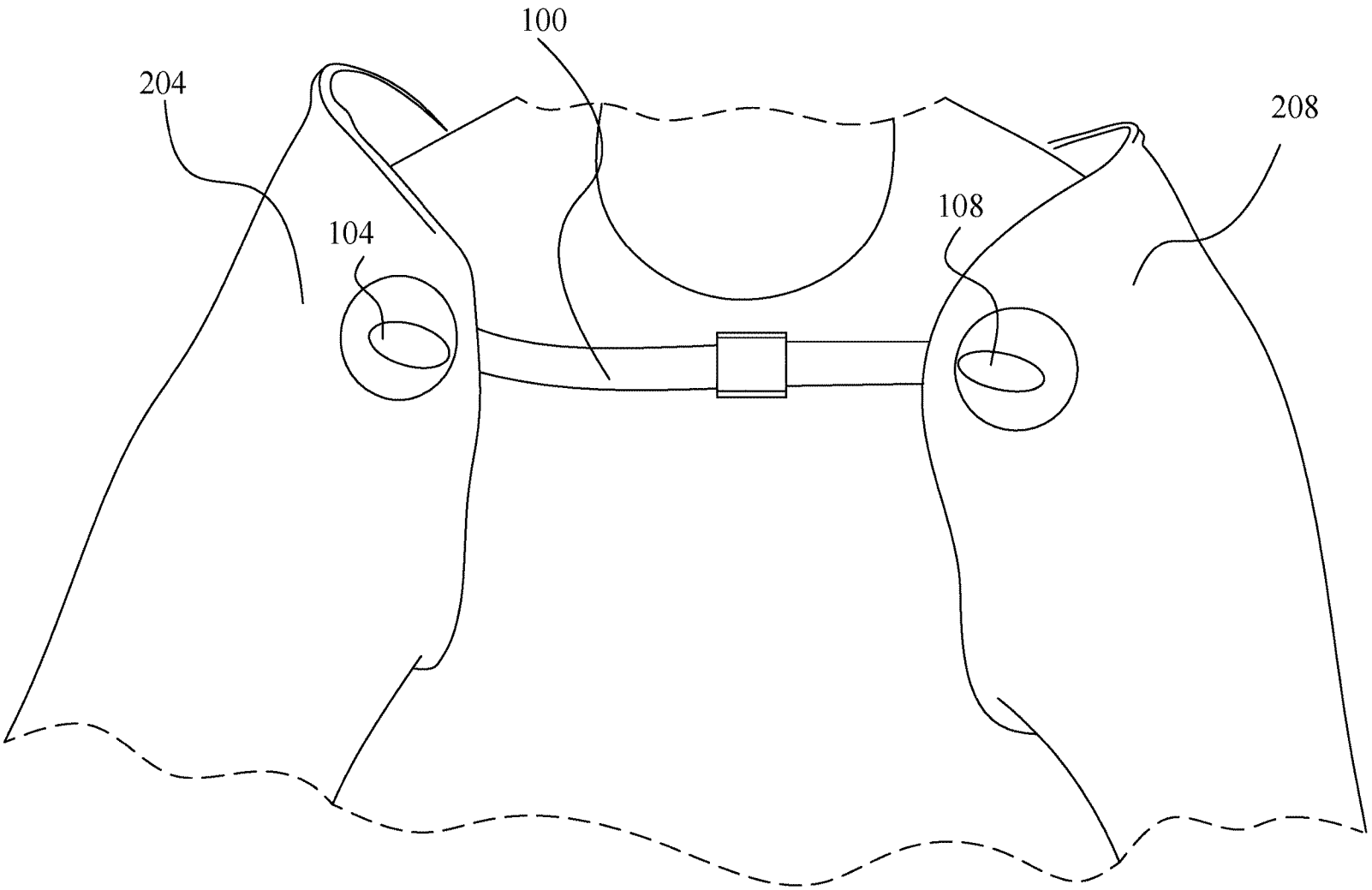
FIG. 2 is a schematic diagram illustrating an exemplary embodiment of a strap assembly combined with protective sleeves.

First connector 104 is configured to connect to a first protective sleeve 204, and second connector 108 is configured to connect to a second protective sleeve 208. FIG. 2 illustrates an exemplary embodiment of strap assembly 100 with first connector 104 attached to a first protective sleeve 204 and a second connector 108 attached to a second protective sleeve 208. Sleeves may be formed from any suitable material and/or combinations of materials, including without limitation natural or artificial rubbers, silicones, textiles, leather, or the like; persons skilled in the art, upon reviewing the entirety of this disclosure, will be aware of various materials and/or combinations of materials that may be suitable for use as protective sleeves. Protective sleeves may have any of various protective properties, including fire resistance, fire-retardant properties, electrical resistance to protect against electrical shock, low thermal conductivity to protect against burns, and/or some degree of padding and/or protection from cuts and/or blows resulting from thickness and/or toughness of material.

Still referring to FIG. 2, in an embodiment, protective sleeves may include elements to which first and/or second connector 108 may attach, any permanent and/or detachable fastening system may be used, including without limitation buckles, snaps, rivets, sewing, adhesion, heat-sealing or the like. As a non-limiting example, protective sleeves may include buttonholes 340 or grommets through which a button or other projecting member of first connector 104 and/or second connector 108 may insert.

Referring again to FIG. 1, in an embodiment, each or either of first connector 104 and second connector 108 may have an effectively rigid button element 112, where "effectively rigid" may have the meaning ascribed thereto above, the button element 112 having a proximal end affixed to the body and a flanged distal end; each of first connector 104 and second connector 108 may have an effectively rigid body attached to a button element 112, where attachment may include any manner of attachment, including fusion or manufacture of both body and button element 112 together as a monolithic whole. Flanged distal ends may be formed to insert sideways through the holes 340 and engage the hole perimeters to prevent removal. In an embodiment, flanged distal end has a width and a length, where the length may be greater than the width; for instance, the length may be more than twice the width. In an embodiment, flanges may be asymmetrical with respect to placement of proximal end; that is, flanges may extend farther from proximal end, along an axis orthogonal to an axis of a main stalk element joining proximal end to distal end, than along another such orthogonal axis. Flanges may have a pear-drop shape and/or a substantially larger area than the holes 340. Either or each of first connector 104 and second connector 108 may have a slot 124 shaped to admit a strap.

With continue reference to FIG. 1, strap assembly 100 includes a strap 128. Strap may be constructed of any flexible material and/or set of materials, including without limitation membranes or sheets of polymer material, natural materials such as leather, and/or natural or artificial textiles. Strap may be effectively fire-resistant, wherein the strap 128 is effectively melt-resistant, have high tensile strength, and/or have high electrical resistivity, as defined above. Strap may be constructed using elastic and/or inelastic materials, which may be combined in various ways; for instance and without limitation, strap may be constructed loosely woven mesh or webbing of effectively inelastic fiber such as meta-aramid fibers, aramid fibers, KEVLAR, NOMEX, or the like that may permit stretching within a certain range owing to slackness of fibers when embedded elastic strands are elastically neutral; thus, elasticity of strap 128 may be equivalent to elastic component within such a range. Strap may evince elastic properties such as an approximate 80% manual stretch range; where strap is a combination of elastic and inelastic materials, strap may be have similarly to a neoprene or other elastic textile material within a range of motion permitted by inelastic materials and behave inelastically beyond that point. Materials making up strap may include, without limitation NOMEX, neoprene, KEVLAR, TWARON, meta-aramid, aramid, or any other suitable artificial or natural fibers, any of which may be spun, filament, or craq-spun. For instance, and without limitation, strap may be 72% NOMEX and 18% Neoprene.

Continuing to refer to FIG. 1, strap 128 has a first end 132 affixed to the first connector 104. First end 132 may be attached to first connector 104 in any suitable way, including riveting, adhesion, clamping, or the like. In an embodiment, first end 132 may be passed through a slot 124 in first connector 104 and affixed to strap 128 by sewing, riveting, adhesion, or the like. Strap 128 has a second end 136, and a strap body 140 connecting the first end 132 to the second end 136. Strap body 140 passes through a slot 124 in second connector 108; as a result, strap body 140 may be slid through the slot 124 to increase or decrease an expanse of strap body 140 between first connector 104 and second connector 108.

Still referring to FIG. 1, strap assembly 100 includes a strap adjustment clip 144. Strap adjustment clip 144 includes a base member 148. Base member 148 may be constructed of any materials suitable for construction of first connector 104 and/or second connector 108. For instance, base member 148 may be constructed of fire-resistant material, non-conductive material, effectively rigid material, and/or melt-resistant material, as described above. As a non-limiting example, base member 148 may be constructed of acrylonitrile butadiene styrene (ABS) with flame retardant additive. Base member 148 is affixed to the second end 136 of the strap 128; attachment of base member 148 to second end 136 may be accomplished using any means suitable for attachment of first end 132 to first connector 104 as described above.

Figure 3:
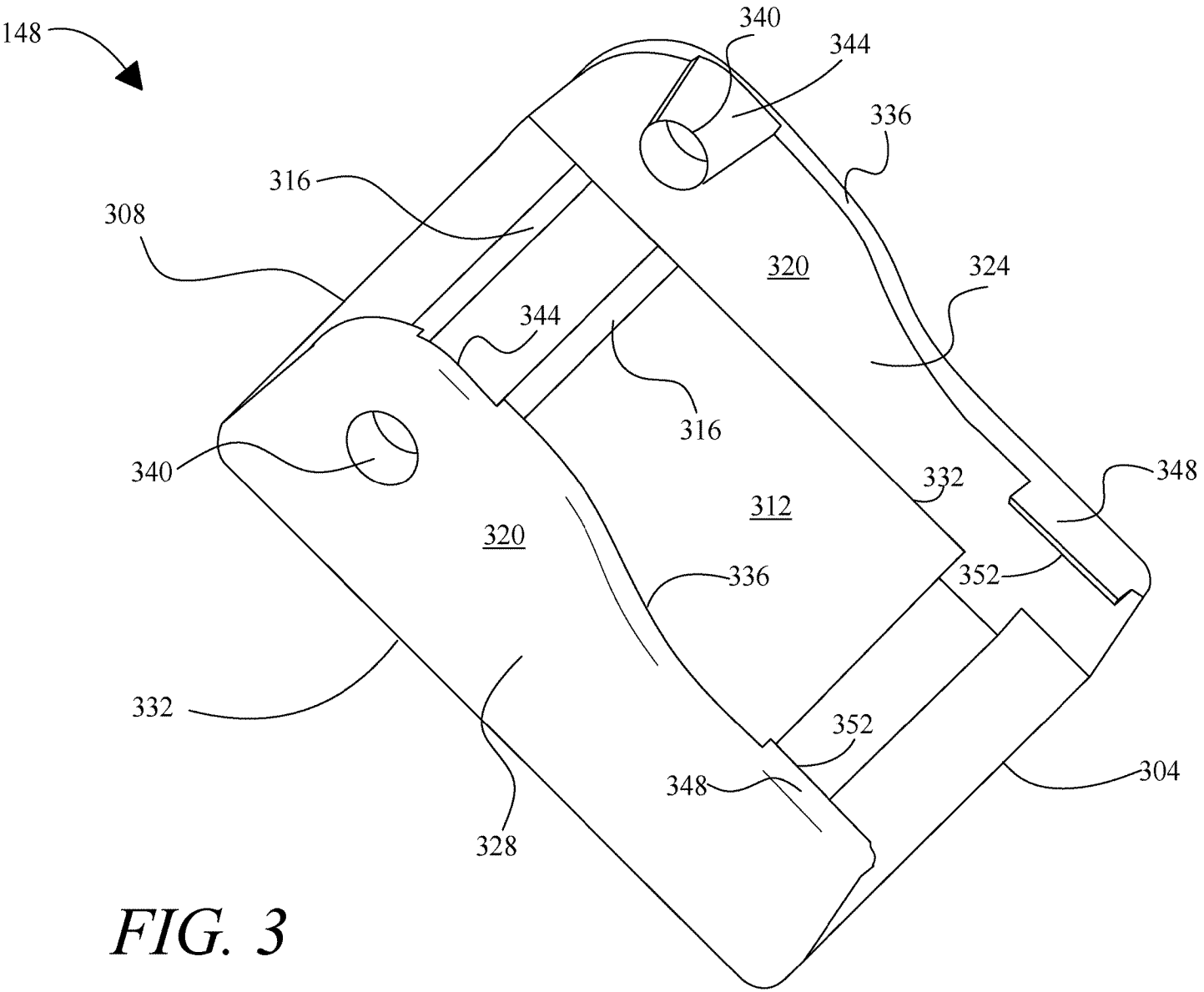
FIG. 3 is a schematic diagram illustrating an exemplary embodiment of a base element of a clip.

Referring now to FIG. 3, an exemplary embodiment of base member 148 includes a front end 304, a rear end 308, and an upper surface 312 disposed on a first side of the strap body 140; in other words, strap body 140 runs over upper surface 312 of base member 148, passes through slot 124 of second connector 108, and returns to base member 148 where it is attached at the first end 132. Base member 148 may also include a bottom surface (not shown) opposite upper surface 312. Upper surface 312 may include at least a ridge 316 projecting from the upper surface 312. At least a ridge 316 may help to secure strap body 140 in clip 144 as described in further detail below. At least a ridge 316 may include multiple ridges; for instance, at least a ridge 316 may include a first ridge and a second ridge.

Still referring to FIG. 3, base member 148 may include two lateral walls 320, which may define borders of a channel through which the strap 128 slides over the upper surface 312. Two lateral walls 320 may include two inner surfaces 324 facing each other and two outer surfaces 328 facing away from each other; in other words, the two inner surfaces 324 may form an interior of a channel through which strap body 140 passes over upper surface 312, while two outer surfaces 328 combine with bottom surface to form an exterior surface of base member 148. Two outer surfaces 328 slope inward with greater distance from the upper surface 312; that is, two lateral walls 320 may have lower edges 332 at upper surface 312 and two upper edges 336 and may be thicker at lower edges 332 than upper edges 336. Inner surfaces 324 may be substantially orthogonal to upper surface 312 with outer surfaces 328 angling toward inward surfaces to narrow upper edges 336 of lateral walls 320. In an embodiment, this tapering may buttress lateral walls 320 against outward flexion and/or elastic deformation of lateral walls 320, preventing accidental disassembly of clip 144. Lateral walls 320 may each include holes 340 or other bearing features for attachment of a locking member and/or a fulcrum or fulcrum extension as described in further detail below. Shallow grooves 344 on inner surfaces 324 may run from holes 340 and/or bearing features to upper edges 336, which may aid in insertion of fulcrum extensions 516 or the like. Each lateral wall of two lateral walls 320 may include a projecting element 348; each projecting element 348 may be substantially ridge-shaped or may have any other suitable form such as a bump. In an embodiment a ridge-shaped projecting element 348 may provide greater resistance to opening clip 144 and/or rotating a locking element to an unlocked position as described in further detail below. projecting elements 348 may be placed on inner surfaces 324. projecting elements 348 may be placed at or near front end 304 of base member 148. Each projecting element 348 may have a projecting element distal end 352. Lateral walls may have gaps or discontinuities, such as a first part bearing fulcrum and a second discrete part bearing projecting element or elements, or the like. Persons skilled in the art, upon reviewing the entirety of this disclosure, will be aware of various alternative forms that lateral walls 320 may take consistently with this disclosure.

Figure 4A:
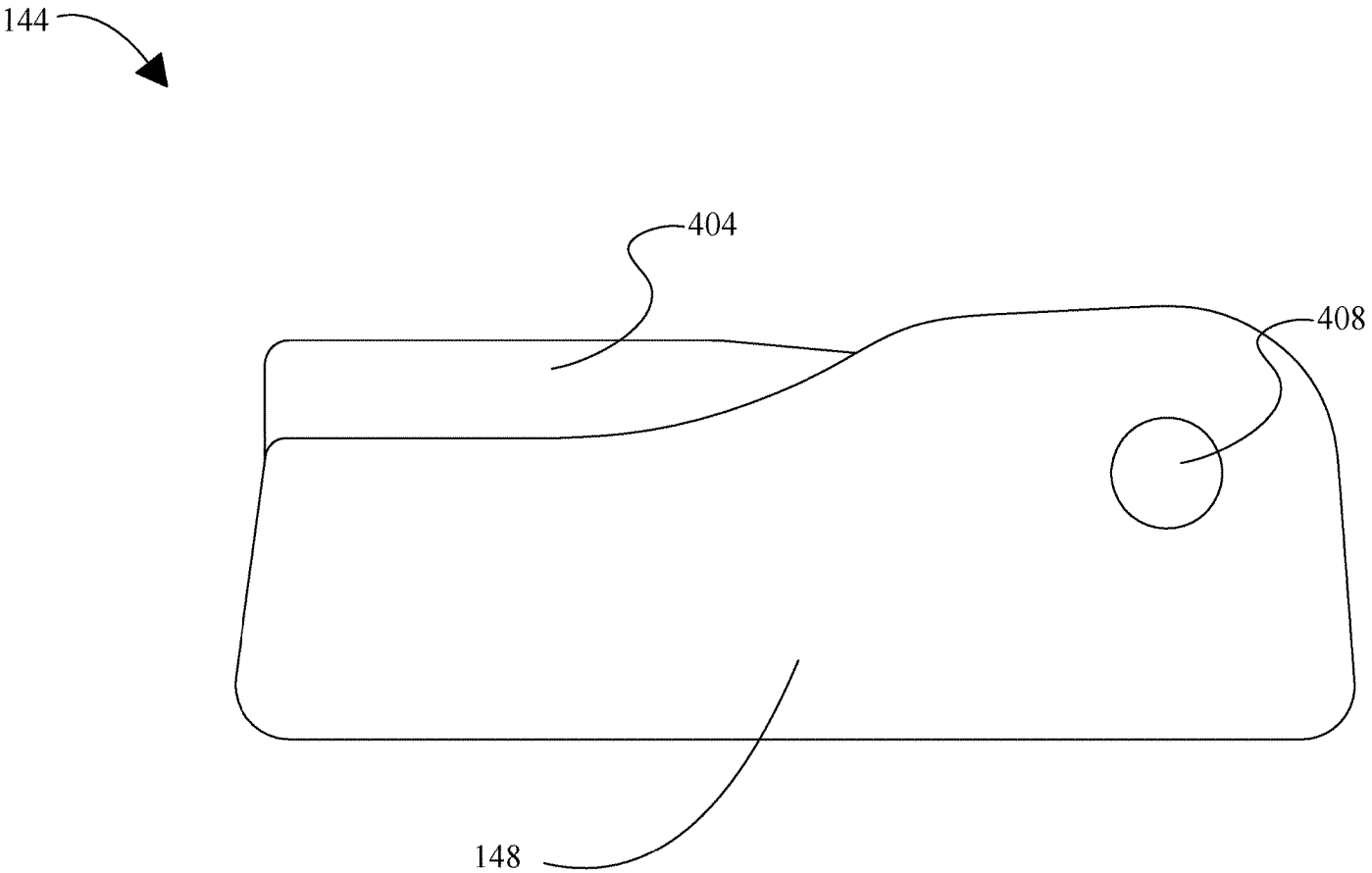
FIGS. 4A-B are schematic diagrams illustrating an exemplary embodiment of a clip.

Referring now to FIG. 4A, clip 144 may include a locking member 404. Locking member 404 may be constructed of any material and/or combination of materials suitable for construction of first connector 104, second connector 108, and/or base member 148 as described above. For instance, and without limitation, locking member 404 may be constructed at least in part of fire-resistant material, electrically resistive and/or non-conductive material, high-strength material, melt-resistant material, or the like. As a non-limiting example, locking member 404 may be constructed of ABS with flame retardant additive.

Figure 4B:
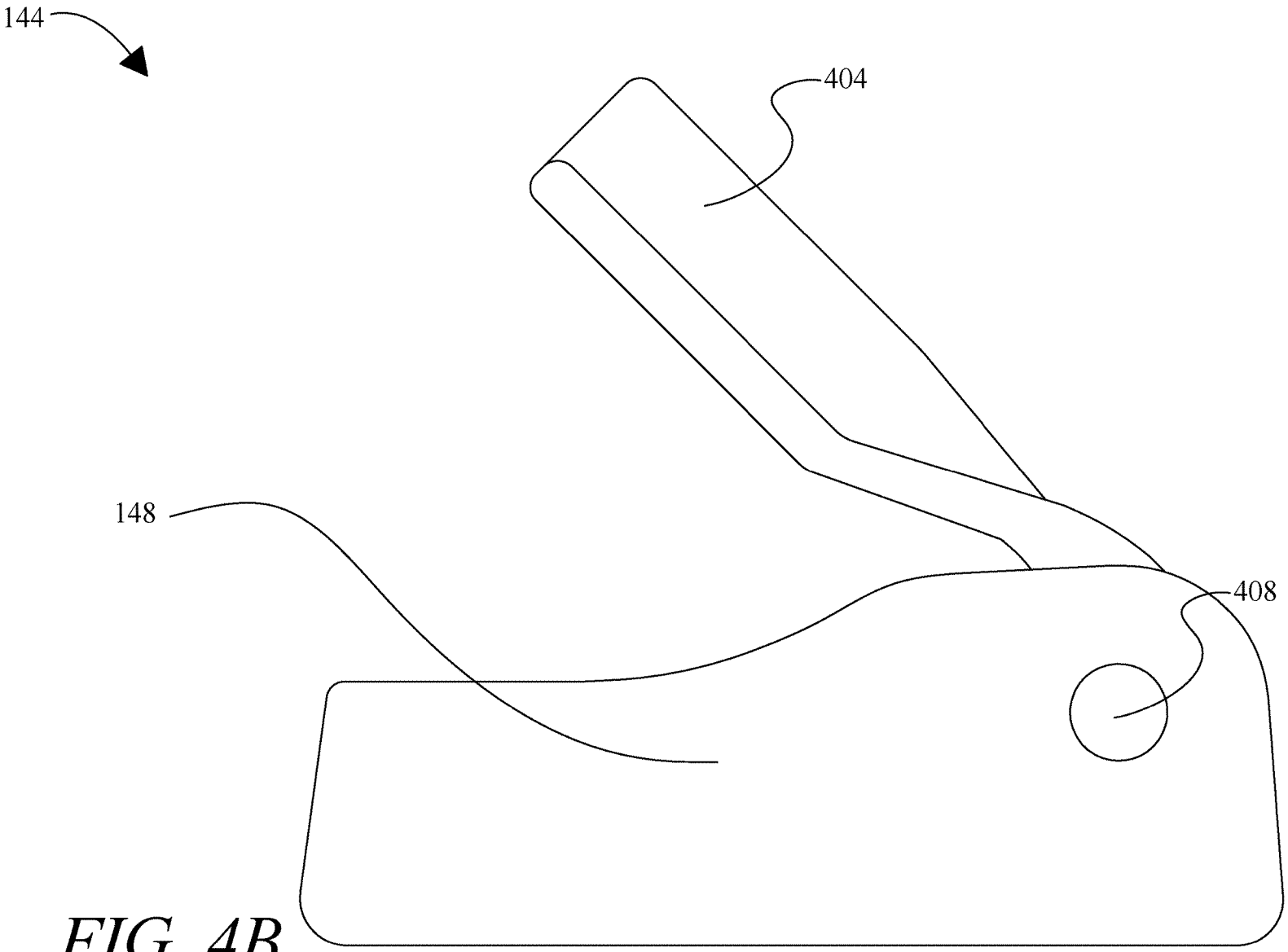

Still referring to FIG. 4A, locking member 404 may be rotatably attached to the base member 148 and disposed on a second side of the strap body 140, with a result that strap body 140 may be slidably secured between locking member 404 and base member 148, such that strap body 140 may slide through a channel with upper surface 312 as a channel bottom and inner surfaces 324 (where present) as channel sides. Locking member 404 is rotatable between a locked position, in which the strap body 140 is prevented from sliding between the base member 148 and the locking member 404, as shown for illustrative purposes in FIG. 4A, and an open position in which the strap body 140 is free to slide between the base member 148 and the locking member 404, as shown for instance in FIG. 4B. Locking member 404 includes a fulcrum 408 attached to the base member 148, and about which locking member 404 may rotate between open position and locked position.

Figure 5:
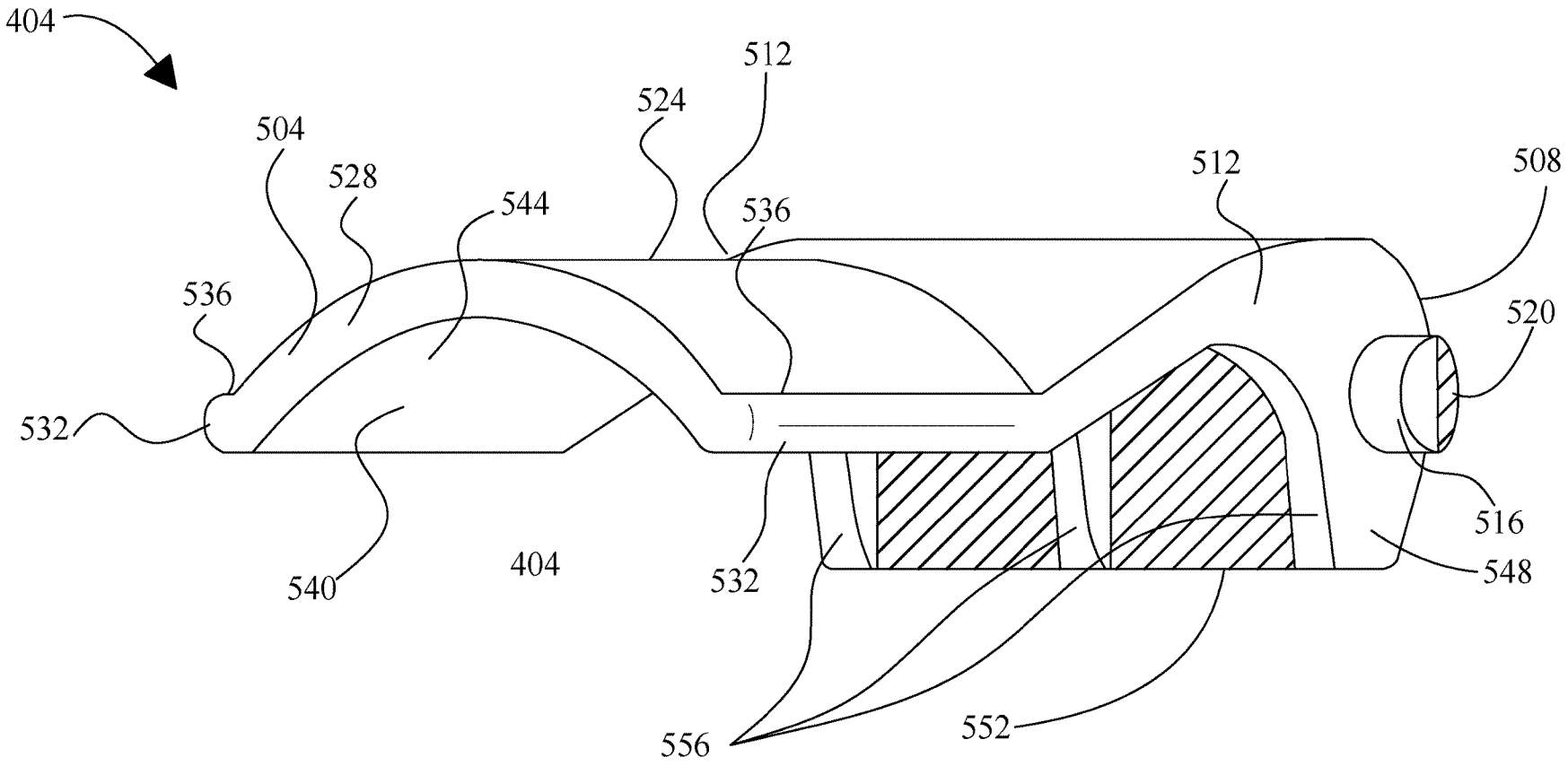
FIG. 5 is a schematic diagram illustrating an exemplary embodiment of a locking element.

Referring now to FIG. 5, an exemplary embodiment of locking member 404 is illustrated. Locking member 404 may have a forward end 504, back end 508, and/or lateral sides 512. Fulcrum 408 may be formed to connect to a bearing element on lateral walls 320 of base member 148. For instance, fulcrum 408 may include a fulcrum extension 516 at each lateral side, which may be formed, as a non-limiting example, for insertion into holes 340 in lateral walls 320; where holes 340 are circular, for instance, each fulcrum extension 516 may be cylindrical in form to allow for smooth rotation of locking member 404. Each fulcrum extension 516 may include a proximal end attached to locking member 404 and a distal end that may extend, as a non-limiting example, into a hole. Each distal end may include a wedge cam 520 or inclined plane at distal end; for instance, where distal end forms a substantially planar surface orthogonal to an axis drawn away from a lateral side of locking member 404 and into, as a non-limiting example, a hole, wedge cam 520 and/or inclined plane may form a surface angling back or "cut away" from the substantially planar surface. In an embodiment, wedge cam 520 may be used to aid in insertion of each fulcrum extension 516 into a corresponding hole by slightly forcing lateral walls 320 outward when fulcrum extensions 516 are forced downward toward upper surface 312 and holes 340, for instance by traveling in shallow grooves 344. This may enable fulcrum extensions 516 to be slid down into holes 340 against an elastic recoil force exerted by displaced lateral walls 320, which force may then "snap" lateral walls 320 back into position, securely trapping fulcrum extensions 516 in holes 340 and preventing ejection of locking member 404.

Still referring to FIG. 5, locking element includes a lever extension 524. Lever extension 524 is manually engageable to rotate locking member 404 between locked position and open position. In other words, a user may be able to lock and open locking member 404 by pushing and pulling on lever extension 524 to rotate the locking member 404. Lever extension 524 may be substantially parallel to an interior surface of the channel when in the locked position. Lever extension 524 may have a lever extension distal end 528, and a proximal end which may be located at fulcrum 408. Lever extension distal end 528 may have a width, which may be substantially equal to or very slightly less than a width of a channel formed by upper surface 312 and inner surfaces 324; width of distal end may be substantially equal to or very slightly less than a distance between inner surfaces 324. In an embodiment, where each of two lateral walls 320 has a projecting element 348, a distance between projecting element distal ends 352 may be less than width of lever extension distal end 528, and/or a width of a portion of lever extension 524 corresponding to locations of projecting elements 348; as a result, a portion of lever extension 524 such as the lever extension distal end 528 may attach to base member 148 when locking member 404 is in locked position, for instance by pushing lever extension distal end 528 and/or other portion of lever extension 524 past projecting elements 348 into channel, causing elastic displacement and rebound of lateral walls 320, which may "snap" projecting members into a position trapping lever extension 524 and/or a portion thereof such as lever extension distal end 528 between projecting elements 348 and upper surface 312 so that the locking member 404 is secured in the locked position.

With continued reference to FIG. 5, lever extension 524 may further include two outer edges 532 that are proximate to inner surfaces 324 when the locking member 404 is in the locked position. Each of two outer edges 532 may include a horizontal shelf 536 that projects under one of the two projecting elements 348 when the locking member 404 is in the locked position. Horizontal shelf 536 may present an upward-facing surface that may be opposed by a downward facing surface of a projecting element 348, which may increase resistance to movement of locking member 404 into open position; this may help to ensure that only a user voluntarily opening clip 144 is likely to cause clip 144 to open, which may enhance security of clip 144.

Still referring to FIG. 5, lever extension 524 may include a lower surface 540 that faces the upper surface 312 when the locking member 404 is in the locked position. Lower surface 540 may be concave. In an embodiment, all or substantially all of the lower surface 540 may be concave, which may act to prevent adhesion of lever member to strap 128, for instance when exposed to high temperatures or other conditions that may cause heat or chemical adhesion, making opening clip 144 unduly difficult. In an embodiment, concavity of lower surface 540 may, as a non-limiting example cause a central portion of the lower surface 540 defined as a portion of the lower surface 540 containing a central longitudinal axis thereof running from proximal end to distal end, does not contact the strap 128 when locking member 404 is in locked position. Concavity may have any uniform and/or variable cross-section shape; for instance, and without limitation concavity may, without limitation, be substantially semi-cylindrical and/or arcuate in form. A superior surface of lever extension 524 may have a form that parallels that of lower surface 540; this may save material costs, increase efficiency of manufacture, and/or reduce weight and bulk of clip 144 without sacrificing durability and/or strength. Alternatively or additionally, lower surface 540 may include a concavity at lever extension distal end 528; this concavity may form an opening 544 with first end 132 when locking member 404 is in locked position. Opening 544 may be sized to admit a fingertip. Opening 544 may provide a user with a way to grip lever extension 524 so as to pull it from locked position to open position, which in turn may permit a mechanism securing locking member 404 in the locked position to resist opening more strongly; this may enhance security of clip 144 without sacrificing ease of use.

With continued reference to FIG. 5, locking member 404 includes a strap lock extension 548. Strap lock extension 548 includes a strap lock proximal end at the fulcrum 408 and a strap lock distal end 552 that traps the strap body 140 against the upper surface 312 of the base member 148 when the locking member 404 is in the locked position, preventing the strap body 140 from sliding between the base member 148 and the locking member 404. Strap lock extension 548 may extend nearly to the upper surface 312; for instance, and without limitation, a distance from strap lock distal end 552 to upper surface 312, when locking member 404 is in locked position, may be less than a thickness of strap 128, with a result that strap body 140 is compressed and/or pinched between strap lock distal end 552 and upper surface 312 when locking member 404 is in locked position, trapping the strap body 140 in between. Strap lock extension 548 may, as a non-limiting example, be disposed substantially orthogonally to the interior surface when in locked position. Downward projecting element 348 has at least a rib 556 on its inner surface. Strap-lock extension and/or rib or ribs may taper from proximal end to distal end, which may increase concentration of force, thus increasing resistance to slippage; ribs may enable a tapered strap lock extension 548 to be strong and minimize flexion, further increasing slip resistance.

Figure 6:
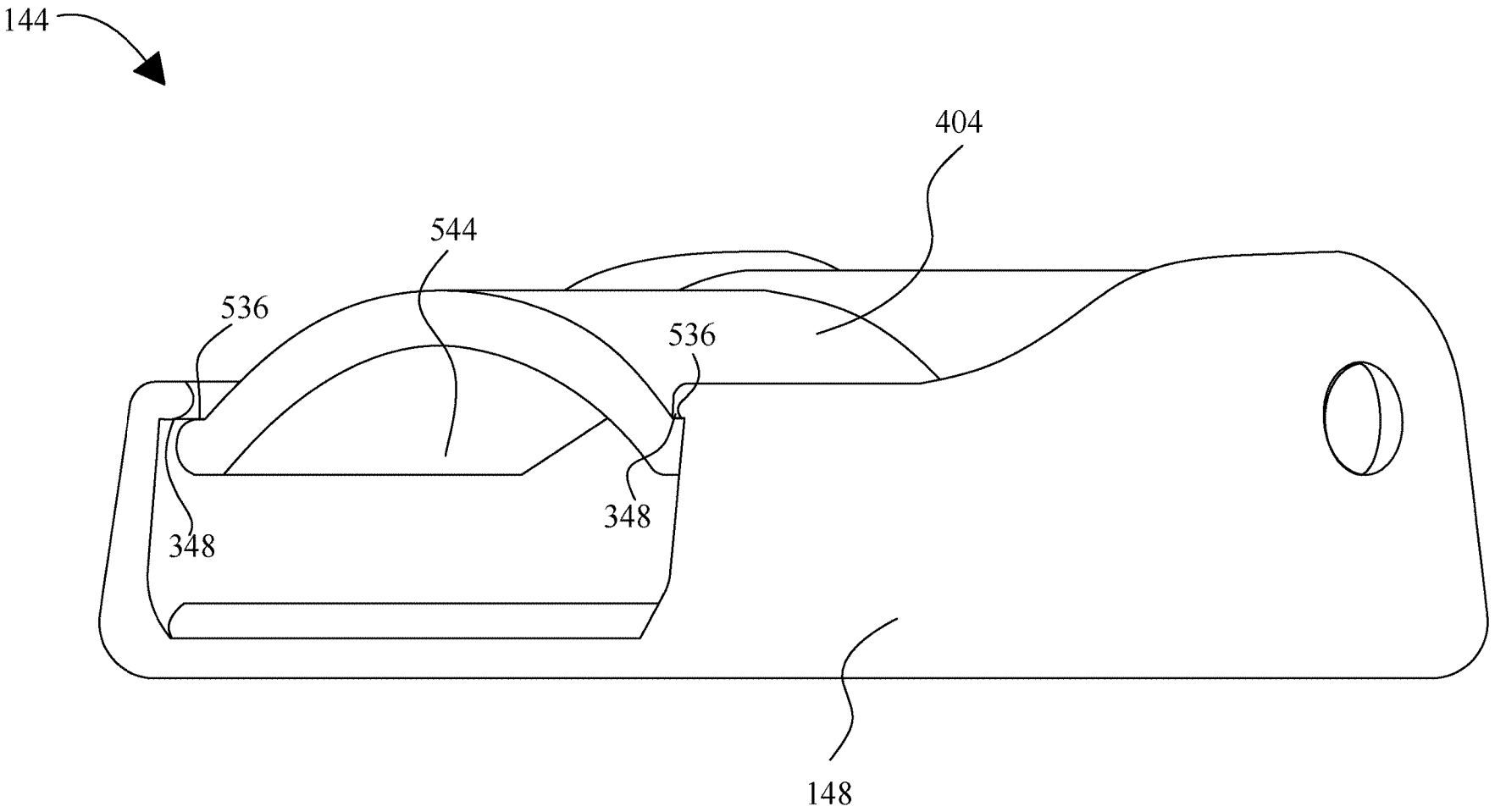
FIG. 6 is a schematic diagram illustrating an exemplary embodiment of clip.

Referring now to FIG. 6, a schematic diagram illustrating an exemplary embodiment of a clip is illustrated. Strap adjustment clip 144 includes a base member 148 and locking member 404, which may be rotatably attached to the base member 148. Base member 148 may include lateral walls. Each lateral wall of two lateral walls may include a projecting element 348; each projecting element 348 may be substantially ridge-shaped or may have any other suitable form such as a bump. In an embodiment a ridge-shaped projecting element 348 may provide greater resistance to opening clip 144 and/or rotating a locking element to an unlocked position. Each of two outer edges of lateral walls may include a horizontal shelf 536 that projects under one of the two projecting elements 348 when the locking member 404 is in the locked position. Horizontal shelf 536 may present an upward-facing surface that may be opposed by a downward facing surface of a projecting element 348, which may increase resistance to movement of locking member 404 into open position; this may help to ensure that only a user voluntarily opening clip 144 is likely to cause clip 144 to open, which may enhance security of clip 144. Additionally, strap adjustment clip 144 may comprise opening 544. Opening 544 may be sized to admit a fingertip. Opening 544 may provide a user with a way to grip lever extension 524 so as to pull it from locked position to open position, which in turn may permit a mechanism securing locking member 404 in the locked position to resist opening-more strongly; this may enhance security of clip 144 without sacrificing ease of use.

Figure 7A:
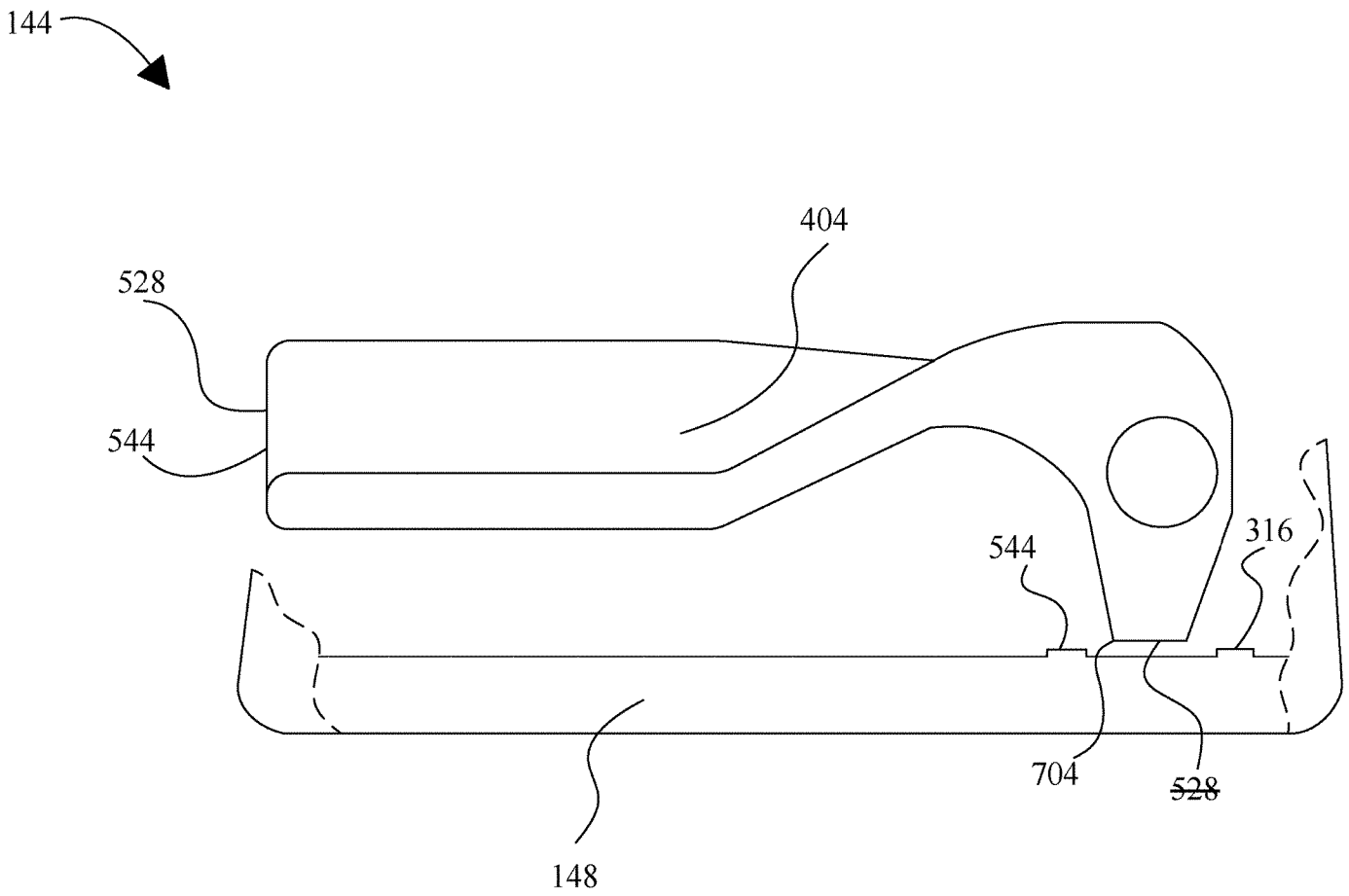
FIGS. 7A-B are schematic diagrams illustrating an exemplary embodiments of a clip.

Referring now to FIG. 7A, the strap lock distal end 552 of the strap lock extension 548 is disposed between the first ridge and the second ridge when the locking member 404 is in the locked position, where "between" as used herein signifies that the ridge of first ridge and second ridge that is nearer to rear end 308 is also nearer to rear end 308 than strap lock distal end 552, while the ridge of first ridge and second ridge that is nearer to front end 304 is also nearer to front end 304 than strap lock distal end 552. In other words, when traversing upper surface 312 from front end 304 to back end 508, one ridge is encountered prior to strap lock distal end 552, while another ridge is encountered subsequent to strap lock distal end 552. In an embodiment, where strap body 140 is effectively elastic as described above, strap lock extension 548 may secure strap body 140 with force greater than a maximal elastic recoil force exerted by the strap 128 when stretched, when locking member 404 is in locked position; maximal elastic force, as used here, is defined as a force exerted when the strap body 140 is stretched to the greatest extent in its elastic range of motion as described above. This property of clip 144 may be a consequence of structural features set forth in further detail below. In an embodiment, clip 144 may prevent slippage of strap body 140 in a direction tending to loosen strap assembly 100, i.e. in a direction being pulled away from clip 144 from rear of base element, when subjected to more than 35 pounds of force.

Figure 7B:
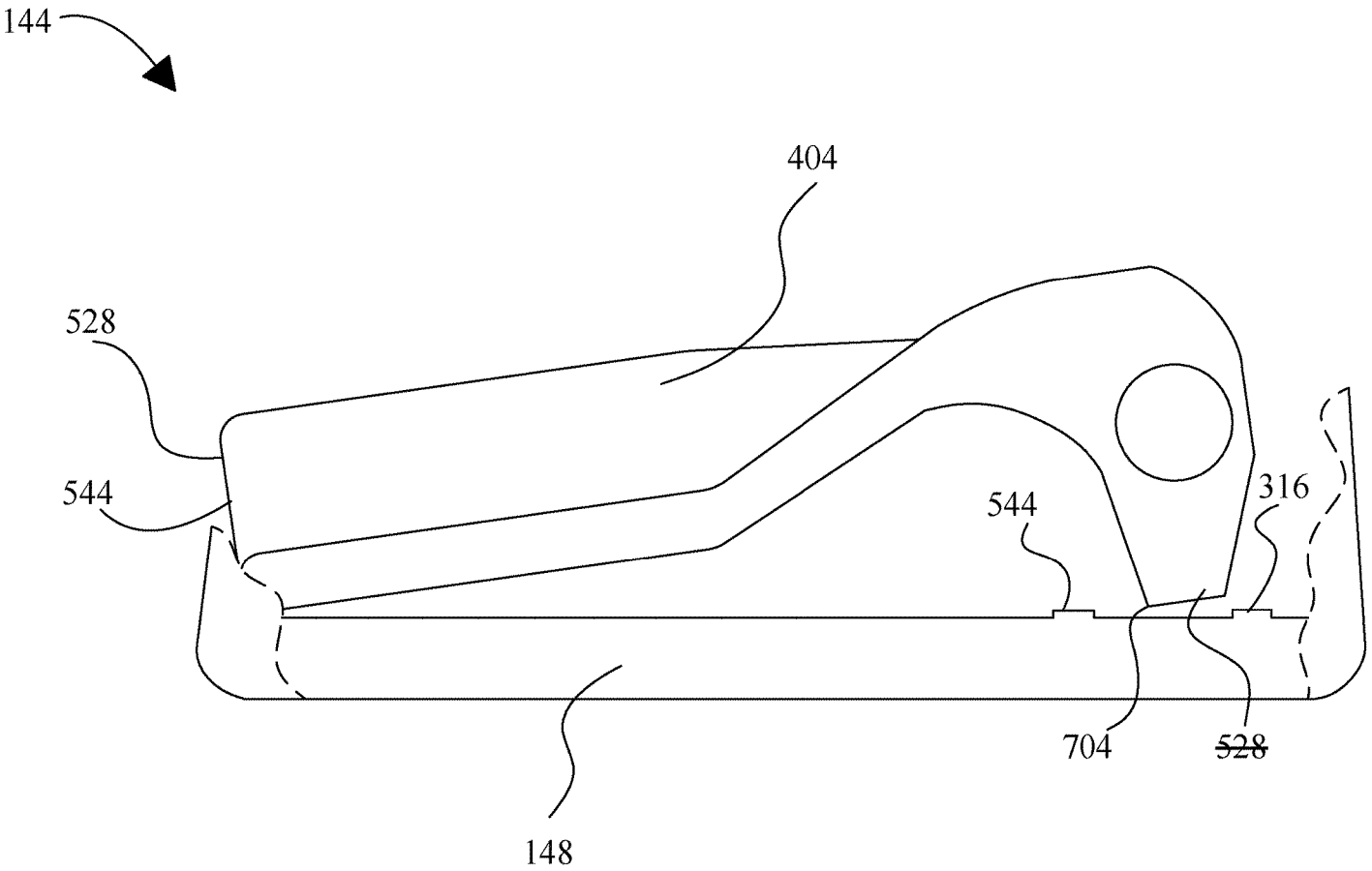

In an embodiment, and still referring to FIG. 7A, strap lock distal end 552 of strap lock extension 548 has a leading edge 704, defined for purposes of this disclosure as an edge at a side of strap lock distal end 552 facing that projects into the strap body 140 when the lever extension 524 is rotated downward while the locking member 404 is in the locked position, for instance as illustrated in FIG. 7B. This may cause leading edge 704 to bite into strap body 140, increasing pressure on strap body 140 along leading edge 704 and generating greater resistance to sliding of strap body 140 relative to clip 144. In an embodiment, biting and/or projecting leading edge 704 may combine at least a ridge 316 on upper surface 312 to grip strap body 140 in a manner similar to a set of interlocking teeth. In an embodiment, locking member 404 may be configured to rotate the lever extension 524 downward when the strap body 140 is pulled from the rear end 308 of the base; this may cause leading edge 704 of strap lock distal end 552 to bite into strap body 140 when the latter is pulled toward the rear of base member 148. As that is the direction in which strap body 140 is pulled to loosen strap assembly 100, this may cause clip 144 to preferentially resist loosening; as a result, when strap assembly 100 is tightened to secure protective sleeves, it is less likely to loosen, and sleeves may be kept firmly in position, preventing exposure to additional danger that might result from displacement of the protective sleeves. Configuration to rotate locking member 404 distal end downward upon rearward tension on strap body 140 may occur because strap body 140 may tend to pull strap lock distal end 552 toward rear end 308 of base under such circumstances. Rotation in a reverse direction may be prevented beyond a certain point by projecting elements 348, where present.

Still referring to FIG. 7B, clip 144 may have one or more material properties as a result of material composition of base element and/or locking element. For instance, and without limitation, clip 144 may be composed at least in part of fire-resistant and/or flame-retardant material. Clip 144 may be composed at least in part of non-conductive material. Clip 144 may be composed at least in part of effectively rigid material. clip 144 may be composed at least in part of melt-resistant material.

Continuing to refer to FIG. 7B, strap assembly 100 may include an alternative or additional fastener in place of and/or instead of clip 144. Alternative or additional fastener may include any suitable fastener for adjustably securing one portion of a strap to another, including without limitation buckles such as slide-release buckles, buttons, snaps, or the like. As a non-limiting example, alternative or additional fastener may include a press fastener. As used herein, a press fastener is a fastener that couples a first surface to a second surface when the two surfaces are pressed together. Some press fasteners include elements on the first surface that interlock with elements on the second surface; such fasteners include without limitation hook-and-loop fasteners such as VELCRO fasteners produced by Velcro Industries B.V. Limited Liability Company of Curacao Netherlands, and fasteners held together by a plurality of flanged or "mushroom"-shaped elements, such as 3M DUAL LOCK fasteners manufactured by 3M Company of Saint Paul, Minn. Press-fastener may also include adhesives, including reusable gel adhesives, GECKSKIN adhesives developed by the University of Massachusetts in Amherst, of Amherst, Mass., or other reusable adhesives. Where press-fastener includes an adhesive, the adhesive may be entirely located on the first surface of the press-fastener or on the second surface of the press-fastener, allowing any surface that can adhere to the adhesive to serve as the corresponding surface.

A user may operate strap assembly 100 by attaching the first and second ends 136 to right and left protective sleeves, rotating the locking member 404 to the open position, sliding the strap body 140 through the channel to adjust the length of the strap 128 by adjusting a length of a doubled portion between the second end 136 and the clip 144, and then rotating the locking member 404 to the locked position to secure the strap 128 at the adjusted length. A user may loosen strap assembly 100, for instance to remove protective sleeves, by rotating locking member 404 to open position and sliding strap body 140 past clip 144.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments, what has been described herein is merely illustrative of the application of the principles of the present invention. Additionally, although particular methods herein may be illustrated and/or described as being performed in a specific order, the ordering is highly variable within ordinary skill to achieve embodiments as described in this disclosure. Accordingly, this description is meant to be taken only by way of example, and not to otherwise limit the scope of this invention.

Exemplary embodiments have been disclosed above and illustrated in the accompanying drawings. It will be understood by those skilled in the art that various changes, omissions and additions may be made to that which is specifically disclosed herein without departing from the spirit and scope of the present invention.

What is claimed is:

1. A strap assembly for connecting protective sleeves for work with high-voltage electricity, the strap assembly including:

a first protective sleeve having a buttonhole;

a first connector and a second connector, wherein:

the first connector includes a surface and is configured to connect to the first protective sleeve having the buttonhole; and the second connector is configured to connect to a second protective sleeve;

a button comprising a flanged distal end and a distinct stalk having first and second ends, wherein the first end of the stalk is disposed on the surface of the first connector and the flanged distal end is disposed on the second end of the stalk such that the flanged distal end is disposed above and in parallel to the surface of the first connector and extends past an end of the surface of the first connector and wherein the flanged distal end is configured to be received by the buttonhole in the first protective sleeve;

a strap having a first end affixed to the first connector, a second end, and a strap body connecting the first end to the second end, where the strap body passes through a slot in the second connector; and a strap adjustment clip, wherein the strap adjustment clip comprises:

a base member affixed to the second end of the strap, the base member including a front end, a rear end, and an upper surface disposed on a first side of the strap body; and a locking member rotatably attached to the base member and disposed on a second side of the strap body, wherein:

the locking member is rotatable between a locked position and an open position;

the locking member includes a fulcrum attached to the base member, a lever extension having a lever extension distal end, and a strap lock extension;

the strap lock extension includes a strap lock proximal end at the fulcrum and a strap lock distal end that traps the strap body against the upper surface of the base member when the locking member is in the locked position, preventing the strap body from sliding between the base member and the locking member; and the lever extension is manually engageable to rotate the locking member between the locked position and the open position.

2. The strap assembly of claim 1, wherein the flanged distal end has a width and a length, wherein the length is more than twice the width.

3. The strap assembly of claim 1, wherein the base member further comprises at least a ridge projecting from the upper surface.

4. The strap assembly of claim 3, wherein: the at least a ridge projecting from the upper surface further comprises a first ridge and a second ridge; and the strap lock distal end is disposed between the first ridge and the second ridge when the locking member is in the locked position.

5. The strap assembly of claim 1, wherein the base member further comprises two lateral walls, the two lateral walls including two inner surfaces facing each other and two outer surfaces facing away from each other.

6. The strap assembly of claim 5, wherein the fulcrum is mounted to the two lateral walls.

7. The strap assembly of claim 5, wherein the two outer surfaces of the two lateral walls slope inward.

8. The strap assembly of claim 5, wherein:

the lever extension distal end has a width;

each of the two lateral walls has a respective projecting element with including a projecting element distal end; and a first end of a first projecting element distal end of a first lateral wall of the two lateral walls is disposed a distance away from a first end of a second projecting element distal end of a second lateral wall of the two lateral walls, said distance being less than the width of the lever extension distal end.

9. The strap assembly of claim 8, wherein:

the lever extension further comprises two outer edges that are proximate to the two inner surfaces when the locking member is in the locked position; and each of the two outer edges further comprises a horizontal shelf that projects under one of the two projecting elements disposed on the base member of strap assembly when the locking member is in the locked position.

10. The strap assembly of claim 1, wherein:

the lever extension includes a lower surface that faces the upper surface when the locking member is in the locked position; and the lower surface is concave.

11. The strap assembly of claim 1, wherein:

the lever extension has a lower surface that faces the upper surface when the locking member is in the locked position; and the lower surface includes a concavity at the distal end of the lever extension, the concavity forming an opening with the first end when the locking member is in the locked position.

12. The strap assembly of claim 1, wherein the strap lock distal end has a leading edge that projects into the strap body when the lever extension is rotated downward while the locking member is in the locked position.

13. The strap assembly of claim 1, wherein the locking member is configured to rotate the lever extension downward when the strap body is pulled from the rear end of the base.

14. The strap assembly of claim 1, wherein the strap lock extension further includes at least a rib disposed on an inner surface of the strap lock extension.

15. The strap assembly of claim 1, wherein the clip is made of fire-resistant material.

16. The strap assembly of claim 1, wherein the clip is made of non-conductive material.

17. The strap assembly of claim 1, wherein the clip is made of melt resistant material.

* * * * *